US009583884B1

(12) United States Patent
Wang

(10) Patent No.: US 9,583,884 B1
(45) Date of Patent: Feb. 28, 2017

(54) ELECTROSTATIC DISCHARGE (ESD) SAFE CONNECTOR INSERT

(71) Applicant: NORTHROP GRUMMAN SYSTEMS CORPORATION, Falls Church, VA (US)

(72) Inventor: Ge Wang, Los Alamitos, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 15/054,424

(22) Filed: Feb. 26, 2016

(51) Int. Cl.
*H01R 13/52* (2006.01)
*H01R 13/648* (2006.01)

(52) U.S. Cl.
CPC ..... *H01R 13/6485* (2013.01)

(58) Field of Classification Search
CPC .... H01R 13/5219; H01R 35/02; H01R 13/523
USPC ..... 439/271, 362, 382
See application file for complete search history.

(56) References Cited

U.S. PATENT DOCUMENTS

| | | | |
|---|---|---|---|
| 3,702,372 | A | 11/1972 | Troccoli |
| 3,793,614 | A | 2/1974 | Tachick et al. |
| 4,293,182 | A | 10/1981 | Schwartz |
| 5,099,380 | A | 3/1992 | Childers et al. |
| 5,364,292 | A | 11/1994 | Bethurum |
| 5,620,341 | A | 4/1997 | Peng et al. |
| 5,674,083 | A | 10/1997 | Whiteman, Jr. et al. |
| 5,947,773 | A | 9/1999 | Karam |
| 6,051,307 | A | 4/2000 | Kido et al. |
| 6,217,382 | B1 | 4/2001 | Ziers |
| 6,241,537 | B1 | 6/2001 | Tate et al. |
| 6,382,997 | B2 | 5/2002 | Semmeling et al. |
| 6,447,316 | B1 | 9/2002 | Jon et al. |
| 6,559,649 | B2 | 5/2003 | Deleu et al. |
| 6,579,116 | B2 | 6/2003 | Brennan et al. |
| 6,689,835 | B2 | 2/2004 | Amarasekera et al. |
| 6,729,907 | B1 | 5/2004 | Edenhofer et al. |
| 7,052,763 | B2 | 5/2006 | Swift et al. |
| 7,223,922 | B2 | 5/2007 | Bandy, IV et al. |
| 7,410,370 | B2 | 8/2008 | Sprouse et al. |
| 7,481,676 | B2 | 1/2009 | Walter et al. |
| 7,758,386 | B2 | 7/2010 | Chang et al. |
| 7,972,150 | B1 | 7/2011 | Lin |
| 8,003,014 | B2 | 8/2011 | Breay et al. |
| 8,085,510 | B2 | 12/2011 | Iben |
| 8,405,950 | B2 | 3/2013 | Iben et al. |
| 8,445,789 | B2 | 5/2013 | Iben et al. |
| 8,514,534 | B2 | 8/2013 | Bandy, IV et al. |
| 8,827,569 | B2 * | 9/2014 | Yamada ..... H01R 13/621 385/56 |
| 9,136,036 | B2 | 9/2015 | Bryant et al. |

(Continued)

*Primary Examiner* — Phuong T Nguyen
(74) *Attorney, Agent, or Firm* — John A. Miller; Miller IP Group, PLC

(57) ABSTRACT

A dissipative insert provided within an electrical connector having multiple connector pins and an outer conductive housing where the insert is configured around the pins within the housing and provides structural integrity thereto and prevents a short circuit between the pins and between the pins and the housing. The insert is comprised of a mixture of a polymer and a conductive material that causes the insert to have a volume resistivity in the range of $1\times10^{6}$-$1\times10^{10}$ ohm-cm. In one embodiment, the conductive material is carbon nanotubes.

19 Claims, 1 Drawing Sheet

(56) References Cited

U.S. PATENT DOCUMENTS

| | | | | |
|---|---|---|---|---|
| 2005/0042922 | A1 | 2/2005 | Haller et al. | |
| 2006/0024986 | A1 | 2/2006 | Rafter et al. | |
| 2007/0284133 | A1 | 12/2007 | Iben et al. | |
| 2010/0084616 | A1 | 4/2010 | Brule et al. | |
| 2010/0239938 | A1* | 9/2010 | Tiquet ..... | H01M 8/0273<br>429/465 |

* cited by examiner

ELECTROSTATIC DISCHARGE (ESD) SAFE CONNECTOR INSERT

BACKGROUND

Field

This invention relates generally to an insert for an electrical connector and, more particularly, to an electrically dissipative polymer insert for an electrical connector that encapsulates multiple pins in the connector and allows electrostatic discharge of the pins, but is still compliant with stringent resistance requirements of various government and industry connector standards.

Discussion

Small electrical circuits, referred to herein as microcircuits, typically include very small electrical circuit elements and are used for many applications, for example, telecommunications circuits, consumer electronic circuits, etc. One specific application for such microcircuits includes high-speed data communications devices on a spacecraft. These types of microcircuits often employ one or more multi-pin connectors and cables to connect the microcircuit to other circuits. A typical multi-pin connector generally includes an insert made of a highly insulating dielectric having a high resistivity that prevents current paths between the pins and between the pins and an outer enclosure of the connector that is typically connected to chassis ground. These types of microcircuits are often susceptible to electrostatic discharge (ESD), which has the capability of damaging the microcircuits and rendering them at least partially inoperative. One significant problem is the risk that the damage to the microcircuit from electrostatic discharge is not catastrophic, where the microcircuit may later experience failure, such as for example, when on orbit.

During spacecraft assembly, many communications cables are connected to data terminals and multi-pin connectors, where if the cable has electrostatic charge, that charge could discharge into the connector causing damage to the circuit. Thus, significant steps are often taken in this and other assembly environments to prevent such electrostatic discharge. In order to prevent electrostatic discharge damage to a circuit when connecting a cable, it is known in the industry to first discharge the cable connector by connecting each pin in the connector to a discharging device having a high resistance element. Further, workers may be required to wear special clothing and take other steps to reduce the chance of electrostatic discharge.

Various techniques have been attempted in the industry to modify connector construction to mitigate or reduce electrostatic discharge. For example, connector designs have been proposed that employ discharge gaps, metallic grounding strips, discharging pins, discharging clips, discharging devices, dissipative discs, dissipative layers and dissipative surfactants. However, most of these techniques have been less than effective. In the discharge gap design, gaps are fabricated around the pins in the connector so that if the electrostatic charge voltage is high enough, the charge will arc across the gap to a conductor thus dissipating the charge. However, such a connector is difficult to fabricate, and has the drawback that sparking during connecting a connector is undesirable. In addition, the discharge gap designs are typically only effective when the electrostatic discharge results in a high voltage greater than 5000 volts, where modern sensitive microelectronics often have an electrostatic discharge sensitivity of less than 500 volts. Further, discharging pins significantly change the design of a standard connector construction that could make the new connector incompatible with cables that these devices are supposed to be mated with. Also, the effectiveness of a dissipative surfactant is a strong function of humidity in the air. In a dry climate, these surfactants become less affective for dissipating electrostatic charge build-up. Also, surfactants can wear off during the course of connector service life. In the space industries, most of the dissipative surfactants are regarded as surface containments and are prohibited from being used in space flight hardware.

It has previously been proposed in the prior art to provide a voltage-varying resistive polymer in a connector to discharge electrostatic voltages. However, the specifics of the polymer that has the voltage-varying resistance has not been identified, and polymers used, for example, in a poly-tantalum capacitor does break down at a high voltage whether or not it will discharge voltage build-up in the process. Other polymers may carbonize or be charred so that a carbon rich conductive path may develop and alleviate a voltage build-up. However, this process is irreversible and the conductive path may become permanent after the discharge event.

DETAILED DESCRIPTION OF THE EMBODIMENTS

The following discussion of the embodiments of the invention directed to an electrically dissipative polymer insert for a multi-pin connector is merely exemplary in nature, and is in no way intended to limit the invention or its applications or uses. For example, the discussion herein refers to the connector as being suitable for microcircuits on a spacecraft. However, as will be appreciated by those skilled in the art, the insert will have application for use in connectors in other industries, such as telecommunications and consumer electronics industries.

As mentioned above, a typical insert for a multi-pin connector is made of an insulating dielectric polymer having a high resistance that prevents current paths between the pins and between the pins and the outer enclosure of the connector that is typically at chassis ground. Because of the high resistivity of these inserts, electrostatic charge build-up on the pins is prevented from being dissipated. The present invention proposes replacing the known inserts for multi-pin connectors with an electrically dissipative polymer that has, for example, a volume resistivity in the range of $1\times10^{6}$-$1\times10^{10}$ ohm-cm that makes the insert conductive enough to allow electrostatic charge that may develop on the pin to be discharged from the pin to the grounded outer shell, but has a high enough insulation resistance that prevents signals on the pins from interfering with other pins, and where the insert is still compliant with stringent resistance requirements of various government and industry connector standards. To provide this volume resistivity known polymers used for inserts is mixed with a suitable conductive material. In one specific non-limiting embodiment, the dissipative polymer is a mixture of a polymer and carbon nanotubes having a blend suitable to provide the desired volume resistivity, which could be different depending on the specific connector.

Figure 1:
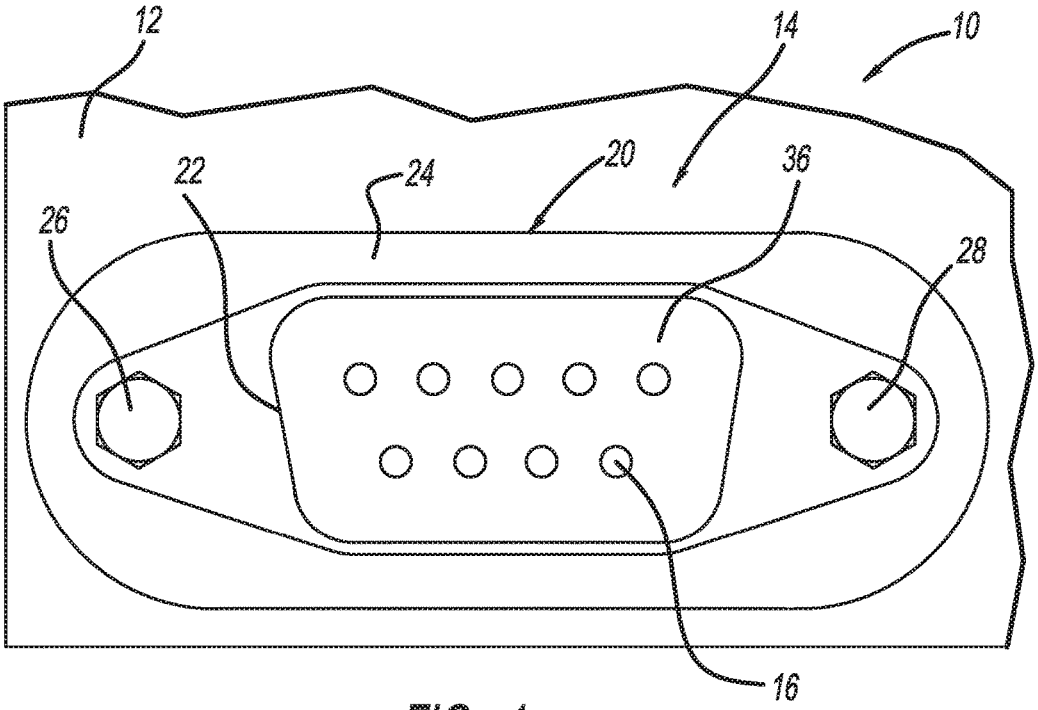
FIG. 1 is a front view of a multi-pin connector coupled to a microelectronic device, where the connector includes an electrically dissipative polymer insert.
Figure 2:
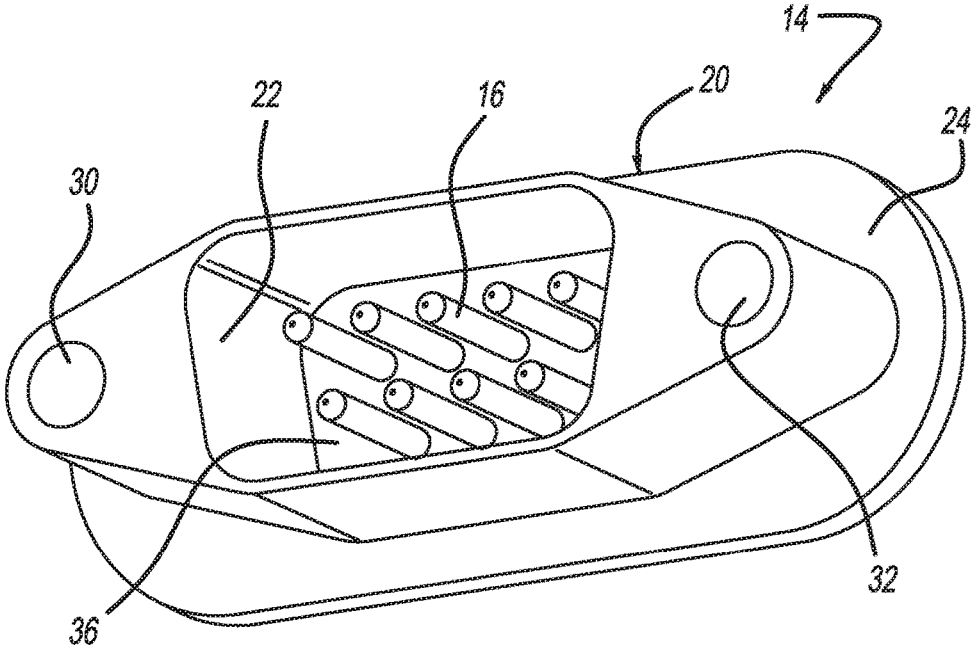
FIG. 2 is an isometric view of the connector shown in FIG. 1.

FIG. 1 is a broken-away front view of an electronic device 10 including a panel 12 to which a multi-pin connector 14 is mounted to and FIG. 2 is an isometric view of the connector 14 separated from the device 10. The device 10 is intended to represent any electrical device, circuit, apparatus, etc. within the scope of the present invention. The connector 14 would be connected to a cable (not shown) having an opposing connector that allows the device 10 to be connected to other devices depending on the application. The connector 14 includes nine connector pins 16 distributed in two rows, however the connector 14 is intended to generally represent all connectors having any suitable number of pins for any specific application within the scope of the present invention. In one embodiment, the pins 16 are made of a copper alloy, such as phosphor bronze or copper beryllium alloy that provide a high yield strength and provides a high spring load at the connector 14 contact to insure a low contact resistance. Further, the pins 16 may be gold plated to prevent the contact surface from oxidizing. The connector 14 further includes an outer conductive housing 20, such as a metal, having an enclosure 22 that surrounds forward facing ends of the pins 16, where the pins 16 extend through the housing 20 and out of a back end of the connector 14. The connector 14 also includes a mounting plate 24 that allows the connector 14 to be mounted to the panel 12 by, for example, bolts 26 and 28 that extend through openings 30 and 32, respectively, so that the housing 20 is electrically coupled to chassis ground.

The connector 10 includes an insert 36 made of an electrically dissipated polymer as discussed herein, where the insert 36 encapsulates the pins 16 within the enclosure 22 so that it surrounds the pins 16, where the insert 36 is recessed back into the enclosure 22 as shown. The insert 36 electrically separates the conductive pins 16 to prevent shorting with each other and mechanically provides structural integrity for the connector 14. The known inserts for multi-pin connectors are typically made of a high temperature polymer having a high dielectric breakdown voltage and a high insulation resistance. The volume resistivity of the known polymer inserts is typically in the range of $1\times10^{12}$-$1\times10^{14}$ ohm-cm, which makes the insert highly insulating. The insert 36 is fabricated by known insert fabrication techniques, such as extrusion molding or other molding techniques, and can have any shape, size, length, etc. for the particular connector. However, instead of being solely a polymer having a very high insulating resistance, the insert 36 is a blend of a polymer and a conductive material that reduces the resistance to allow the insert 36 to be conductive enough to dissipate electrostatic charge, but not conductive enough to conduct the signals being provided to the pins 16, where the volume resistivity of the insert 36 is compliant with the necessary regulations. The specific blend of polymer and conductive material would be application specific within the scope of the present invention. Suitable polymers include, but are not limited to, glass-reinforced diallyl phthalate, glass-reinforced polyester, glass-reinforced polyphenylene, and glass-reinforced liquid crystalline polyester.

In one embodiment, the present invention reduces the volume resistivity of the known polymer insert materials by mixing the polymer with conductive powders, such as graphite or carbon powders. Other suitable conductive materials may include doped silicon, doped germanium, tin oxide or combinations thereof. The conductive path within the otherwise insulating polymer can be established by percolation of the small carbon particle network inside the polymer.

Usually a large volume percent of carbon powder needs to be added into the mixture before a continuous conduction path is formed with the carbon particles. The high percentage of carbon addition into the polymer significantly alters the mechanical and chemical properties of the polymer. For example, the insert becomes brittle and carbon black can easily break off from the connector leaving marks on surfaces that come in contact with the connector. For this reason, heavily carbon-filled polymeric materials are discouraged from being used in space flight hardware. To overcome this limitation, in one embodiment the present invention proposes using commercially available carbon nanotubes in the polymer mixture, which have a very large aspect ratio, i.e., the quotient between the length and diameter of the nanotubes. As such, as small fraction of carbon nanotube mixed with a polymeric material can drastically lower the polymers volume resistivity and become dissipative without changing the materials mechanical properties.

In one embodiment, a suitable polymeric material in compliance with ASTM D5927 or ASTM D5948 is blended with a small amount of carbon nanotubes having a high aspect ratio. The volume fraction of the carbon nanotubes is dependent on the desired insulation resistance of the connector. For MIL-DTL-24308 compliant D-sub connectors, the minimum insulation resistance is $5\times10^{9}$ ohms when measured under a 500 volt DC bias. Therefore, the resulting volume resistivity of the mixture should be somewhere between $5\times10^{8}$-$5\times10^{9}$ ohm-cm. This range of volume resistivity is due to the fact that the insulation resistance of the connector is not only a function of the connector pin arrangement and insert volume resistivity, but the presence or absence of an adjacent pin to a signal path in the design pinout of the system.

The connector 14 fabricated in accordance with the discussion herein is not only compliant with MIL-DTL-24308 specifications in terms of insulation resistance, but the resistance of the insert 36 is such that tribo-electric charge induced during connector and cable handling is rapidly bled to chassis ground through the dissipative path of the insert 36. It is noted that the same insert material can be used for making MIL-DTL-83513 (micro D) connectors.

For consumer electronics, USB connectors and cables are widely used. The minimum insulation resistance of a USB connector is $1\times10^{9}$ ohms. For these types of connectors, the volume resistivity of the insert 36 can be engineered to be $1\times10^{8}$-$1\times10^{9}$ ohm-cm. This volume resistivity can be accomplished by employing carbon-filled dielectrics since carbon particle contamination is generally not a concern for consumer electronics. However, carbon nanotubes can still be used in the mixture to achieve proper volume resistivity for these products as well.

For HDMI connectors and cables that are increasingly being employed in home entertainment equipment, the required minimum insulation resistance of an insert for an HDMI connector is $1\times10^{8}$ ohms. For this design, the dissipative insert 36 for an HDMI connector can be made of carbon-filled polymeric materials having a volume resistivity between $1\times10^{7}$-$1\times10^{8}$ ohm-cm.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A dissipative insert provided within an electrical connector having multiple connector pins and an outer conductive housing where the insert is configured around the pins within the housing and provides structural integrity thereto and prevents a short circuit between the pins and between the pins and the housing, said insert being comprised of a mixture of a polymer and a conductive material that causes the insert to have a volume resistivity in the range of $1\times10^{6}$-$1\times10^{10}$ ohm-cm.

2. The insert according to claim 1 wherein the conductive material is a powder selected from the group consisting of carbon, graphite, doped silicon, doped germanium, tin oxide or combinations thereof.

3. The insert according to claim 1 wherein the polymer is selected from the group consisting of glass-reinforced diallyl phthalate, glass-reinforced polyester, glass-reinforced polyphenylene, and glass-reinforced liquid crystalline polyester.

4. The insert according to claim 1 wherein the insert is a molded insert.

5. The insert according to claim 1 wherein the housing is coupled to a device at chassis ground.

6. The insert according to claim 1 wherein the connector is part of a circuit on a spacecraft.

7. The insert according to claim 1 wherein the connector is a USB connector and the insert has a volume resistivity in the range of $1\times10^{8}$-$1\times10^{9}$ ohm-cm.

8. The insert according to claim 1 wherein the connector is an HDMI connector and the insert has a volume resistivity in the range $1\times10^{7}$-$1\times10^{8}$ ohm-cm.

9. The insert according to claim 1 wherein the conductive material is a carbon material.

10. The insert according to claim 9 wherein the carbon material is carbon nanotubes.

11. An insert provided in a multi-pin connector, said connector including a plurality of pins and an outer conductive shell where the insert is provided around the pins and inside the shell, said insert comprising a mixture of a polymer and carbon nanotubes, wherein the insert has a volume resistivity in the range of $1\times10^{6}$-$1\times10^{10}$ ohm-cm.

12. An electrical connector comprising:

an outer conductive housing;

a plurality of pins extending through the housing and being spaced apart from the housing and each other; and a dissipative dielectric insert positioned within the housing and encapsulating the pins, said insert providing structural integrity to the connector and preventing electrical short circuits between the pins and between the pins and the housing, said insert having a volume resistivity in the range of $1\times10^{6}$-$1\times10^{10}$ ohm-cm.

13. The connector according to claim 12 wherein the connector is a USB connector and the insert has a volume resistivity in the range of $1\times10^{8}$-$1\times10^{9}$ ohm-cm.

14. The connector according to claim 12 wherein the connector is an HDMI connector and the insert has a volume resistivity in the range $1\times10^{7}$-$1\times10^{8}$ ohm-cm.

15. The connector according to claim 12 wherein the insert is a mixture of an insulating polymer and a conductive material.

16. The connector according to claim 15 wherein the conductive material is a powder selected from the group consisting of carbon, graphite, doped silicon, doped germanium, tin oxide or combinations thereof.

17. The connector according to claim 15 wherein the polymer is selected from the group consisting of glass-reinforced diallyl phthalate, glass-reinforced polyester, glass-reinforced polyphenylene, and glass-reinforced liquid crystalline polyester.

18. The connector according to claim 15 wherein the conductive material is a carbon material.

19. The connector according to claim 18 wherein the carbon material is carbon nanotubes.

* * * * *